United States Patent [19]

Cox

[11] 4,041,854

[45] Aug. 16, 1977

[54] SLUDGE DEWATERING

[76] Inventor: Clyde H. Cox, 12723 Gaylawood Drive, Houston, Tex. 77066

[21] Appl. No.: 619,048

[22] Filed: Oct. 2, 1975

Related U.S. Application Data

[60] Division of Ser. No. 477,797, June 10, 1974, Pat. No. 3,938,434, which is a continuation-in-part of Ser. No. 342,772, March 19, 1973, abandoned.

[51] Int. Cl.[2] ..... B30B 9/14

[52] U.S. Cl. ..... 100/112; 100/117; 100/128; 100/145

[58] Field of Search ..... 100/110-117, 100/145-150, 128; 210/225, 298, 414, 415

[56] References Cited

U.S. PATENT DOCUMENTS

| | | | |
|---|---|---|---|
| 2,431,274 | 11/1947 | Osborne | 100/145 UX |
| 3,394,649 | 7/1968 | Kemper et al. | 100/117 X |
| 3,548,743 | 12/1970 | Pikel | 100/145 |
| 3,695,173 | 10/1972 | Cox | 100/117 X |

FOREIGN PATENT DOCUMENTS

| | | | |
|---|---|---|---|
| A9,120 | 6/1908 | France | 100/148 |
| 39,434 | 8/1924 | Norway | 100/148 |

*Primary Examiner*—Peter Feldman
*Attorney, Agent, or Firm*—Owen, Wickersham & Erickson

[57] ABSTRACT

A filter-dewatering-expression apparatus. Rotating helical blades of a screw conveyor compress and squeeze liquid from the sludge within structure which permits the liquid to escape therefrom, and discharge the dewatered solids out the end. The filter-dewatering medium which is held rigid by a frame may be a series of hoops or rings, separated and closely-spaced, or may be a continuous wire, semicircular in cross section, closely wound into a coil, or may be a perforated screen. An imperforate filtrate collection housing surrounds this medium, and a vacuum pump is connected to the filtrate housing. A coil-spring wiping or cleaning blade may be held on the outside edge of the helical blade of the screw conveyor for continuous contact with the inside surface of the filter-dewatering medium, cleaning solids therefrom. Cleaning nozzles project out radially from the outer edge of the helical blades of the screw conveyor, spaced to discharge under pressure, a forceful blast of the air or other gas, steam, or water into the open area of the medium, to positively dislodge material therein and keep the medium unplugged, non-blinded, clean, and open. Air or steam may be added to the sludge within the structure by ports located in the screw conveyor shaft. A removable spiral shaft wrap may be rotated over and wound around, covering the screw conveyor shaft within the structure, threading the helical blade, to vary the inside configuration of the dewatering press. A plural-section screw conveyor may be utilized within the press, each section being capable of being rotated at different speeds of rotation.

12 Claims, 17 Drawing Figures

SLUDGE DEWATERING

REFERENCE TO RELATED APPLICATIONS

This application is a division of application Ser. No. 477,797 filed June 10, 1974, now U.S. Pat. No. 3,938,434, which was a continuation-in-part of application Ser. No. 342,772 filed Mar. 19, 1973, now abandoned.

BACKGROUND OF THE INVENTION

This invention relates to filtration and dewatering of sludge and other slurry. Particularly it relates to an apparatus employing continuous filter-dewatering-expression under vacuum-compression.

Sludge may be defined as a semiliquid deposit or sediment having a total solids concentration of at least 2500 ppm.

Sludge handling and disposal is the most troublesome aspect of wastewater treatment, and it is often the most costly. The problem is increased with efficient wastewater treatment plants being built and operated today producing higher fractions of the waste impurities in the form of sludges than formerly were possible. Also, in advanced wastewater treatment, the use of chemicals produces great quantities of sludge, further complicating the sludge handling and disposal problem.

One step in sludge handling and disposal involves filtration or dewatering, to reduce the sludge moisture content, generally to a non-fluid form, to a degree which allows ultimate disposal by incineration, landfilling, or other methods. Heretofore, sludge filter-dewatering has been attempted principally by open-air bed drying, vacuum filtration, centrifugation, and mechanical separation. A brief comment on each of these techniques may be helpful to an understanding of the purpose and achievements of the present invention.

Open-air drying beds have become less and less attractive, due to reduced land availability and the lessening of public tolerance for techniques open to the atmosphere with the possibility of air pollution.

Vacuum filtration separates the insoluble solids from the liquid by using differential pressures created by a vacuum pump, to force the liquid through a porous medium carried on a rotating drum, on which the solids remain to form a cake. The filter medium, which requires replacement periodically, requires a substantial flow of washwater to prevent plugging or blinding of the open area. The vacuum filter involves large equipment, many moving parts, high operating horsepower, and is expensive to purchase, operate and to maintain.

Centrifuges require high speeds of revolution, typically ranging from approximately 2000 to 4500 rpm. The insoluble solids of the feed slurry or sludge centrifugally settle against the bowl wall, and the liquid flows toward and out a central discharge. The solids are typically pushed out through discharge ports and collected from the bowl. The centrifuge cannot tolerate grit without excessive wear and requires large operating horsepower. They are expensive to purchase, to operate, and to maintain.

Mechanical separation has typically been sought by plate and frame filters, typically comprising an alternating series of empty rings that serve to contain the final filter cake. The plates are covered on both sides with cloth and are provided with drainage channels for removal of the filtrate. The frames are filled with a batch of slurry under pressure, and the filtrate escapes through the cloth and through the plate channels, while the frames are left filled with filter cake. At the end of each cycle, the press is opened and the cake is removed for further treatment or disposal. This is an intermittent or batch type of operation and therefore is associated with the high labor costs resulting from manual operation, so that the plate and frame filters are expensive to operate and very expensive also in first or capital costs.

A typical dewatering screw press of the prior art comprised a rotating screw fitting closely inside a horizontal slotted or perforated curb. The curb and screw were typically tapered toward the discharge end, in order to increase the pressure on the material being dewatered. The discharge end was partially closed by an adjustable cone to vary the discharge opening and thus to vary the pressure on the material within the dewatering press. Rotation of the screw conveyed the material toward the discharge end, and as the pressure increased, the liquid associated with the material was forced out through the slots or perforations in the curb. However, it has been found that the dewatering press of the prior art will not perform satisfactorily on sewage sludges, due to the plugging and blinding of the slots or perforations of the filter-dewatering medium or curb, by the small and stringy solids contained in sewage sludge. The prior art did not provide an effective method or apparatus for cleaning the slots or perforations without interrupting continuous dewatering. Also, the prior art of the dewatering press did not provide for a reduction of the initial or design open area or the perforations or slots in the curb without a complete change of the curb itself.

My earlier U.S. Pat. No. 3,695,173, issued on Oct. 3, 1972, provides an improved apparatus for filtration-dewatering of sludge continuously. It has a permanent filter-dewatering medium comprising a series of hoops or rings separated and closely spaced from each other and held together as a single unit by a frame, and apparatus for continuously cleaning the filter-dewatering medium while filtering or dewatering. To prevent plugging or blinding and interruption of continuous filtration or dewatering, cutter or slot cleaning blades are secured to the outer edge of the screw conveyor, projecting out radially and spaced to extend into the slots or spaces between the closely spaced filter rings or hoops. The fine solids which have entered and become wedged in the spaces between the filter rings tending to plug or blind the open area of the filter-dewatering medium and the small stringy portions of large solids which have entered the spaces between the filter rings, but cannot pass through and out due to the large portions of the solids being retained on the surface of the filter-dewatering medium, are dislodged and pass through and out with the filtrate with the cutting or cleaning action of the cutter or slot-cleaning blades, when the rotating helical blade of the screw conveyor along with the conveyed sludge or dewatered solids, cuts and scrapes away the solids retained on the filter-dewatering medium.

U.S. Pat. No. 3,695,173 also provides apparatus to decrease the initial or design open area of the filter-dewatering medium to prevent undue bleeding of the solids into the filtrate by the utilization of slot-reducing or space-bridging members or material which bridge or partially close or effectively reduce the open area or spaces between the closely spaced filter rings of the filter-dewatering medium when the sludge nature and consistency warrants.

An important object of this invention is to provide a greatly improved apparatus for filter-dewatering-expression of sewage sludge or other slurries. One aspect is directed to improved apparatus for preventing plugging and blinding of the filter-dewatering medium and interruption of the continuous filtration, dewatering, and expression.

A characteristic of the prior art dewatering screw presses was to employ an adjustable choke or cone at the discharge end of the press to vary the discharge opening and control the back pressure within the pressing chamber. It has been found, however, that for dewatering sewage sludge, the adjustable choke or cone at the discharge end of the dewatering press, by itself, will not provide for sufficient variation in back pressure within the press. U.S. Pat. No. 3,518,936 issued to Bredeson provides for adjustably controlling the backup pressure within the press at one or more points intermediate the inlet and discharge ends of the press with annular choke members. However, it has been found that while intermediate choke does increase pressure upon the material at the point of application of the choke, after the material has been conveyed past the choke, the pressure will be reduced. Due to the large variation in the nature and consistency possible with sewage sludge, this cyclic increase and decrease in pressure upon the sludge has been ineffective in adjusting the back pressure within the press. The prior art does not provide for varying the inside configuration of the dewatering press to a great extent, decreasing the dewatering and compression volume within the press, nor changing the dewatering and compression rate within different portions of the press.

The present invention has the further object, therefore, of providing an apparatus for increasing the diameter of the combination sludge compression and dewatered solids discharge screw conveyor shaft, varying the inside configuration of the dewatering press, decreasing the compression volume within the press, changing the compression and dewatering rate within different portions of the dewatering press, and at the same time, decreasing the dewatered solids outlet, thereby varying the quantity and dryness of the dewatered solids discharged from the press.

A further object of this invention is to provide for regulating the quantity and dryness of the dewatered solids discharged from the press.

Other objects and advantages of this invention will be apparent from the ensuing disclosure and appended claims.

SUMMARY OF THE INVENTION

This invention provides a filter-dewatering-expression apparatus for dewatering sewage sludge and other slurries, and for dewatering-expression of filter or centrifuge cake resulting from conventional vacuum filters or centrifuges when a more thorough removal of liquid from the cake is desired.

The apparatus of this invention comprises a flow-impeding structure and a combination sludge compression and dewatered solids discharge screw conveyor. The flow-impeding structure preferably consists of an initial cylindrical portion, a following frustoconical portion, and a terminal cylindrical portion and is the filter-dewatering medium. It comprises either: a series of hoops or rings separated and closely spaced, held rigid by a frame; a continuous wire, semicircular in cross section, closely wound into a coil, held rigid by a frame; or a perforated screen held rigid by a frame. The rotating helical blades of the screw conveyor compress and squeeze liquid from the sludge within the structure through which the liquid escapes, and the screw conveyor discharges the dewatered solids out the end. An imperforate filtrate or liquid collection housing surrounds the structure, and a vacuum pump is connected to the filtrate housing. One end of the screw conveyor shaft is supported for rotation within the structure at the input end and the other end of the shaft protrudes the discharge end and is connected to a suitable source of power.

An important feature of the present invention is that a coil-spring wiping or cleaning blade is positioned on the outside edge of the screw conveyor helical blade to provide continuous contact between the wiping or cleaning blade and the inside surface of the filtering-dewatering medium. The spring action or tendency of the coil-spring blade to expand enables improved wiping action and cleaning of the solids from the inner surface of the medium.

Another significant feature of the invention is a series of cleaning nozzles that project out radially from the outer edge of the helical blades of the screw conveyor and are spaced to discharge, under pressure, a forceful blast of the air or other gas, steam, or water into the open area of the filter-dewatering medium to positively dislodge material therein and keep the filter-dewatering medium unplugged, non-blinded, clean, and open.

Air or steam may be added to the sludge within the structure, while it is operating, by ports located in the screw conveyor shaft.

A removable spiral shaft wrap may be rotated over and wound around, covering the screw conveyor shaft within the structure, threading the spiral-helical blade, to vary the inside configuration of the dewatering press so that the quantity and dryness of the dewatered solids discharged out the end can be varied.

A plural-section sludge compression and dewatered solids discharge screw conveyor may be utilized. Each section is capable of being rotated at different speeds of rotation to regulate the detention time of the sludge within different portions of the structure, changing the dewatering and compression rate within the different portions of the dewatering press, therefore controlling the quantity and dryness of the dewatered solids discharged out the end. In one case, the helical blade section in the frustoconical and the terminal cylindrical portions of the structure is a continuous helical blade and is mounted on a covering shaft which slips over and is concentric to the central shaft of the two section screw conveyor. The helical blade section in the initial cylindrical portion is mounted on the central shaft of the screw conveyor. Both sections are of the same "hand" and may rotate in the same direction and at different speeds of rotation. Both shafts may be driven from the same end.

Cutter or annular slot-cleaning blades may be utilized with the filter-dewatering medium cleaning nozzles to assist in keeping the filter-dewatering medium clean and open, or they may be utilized separately.

DESCRIPTION OF PREFERRED EMBODIMENTS

Figure 1:
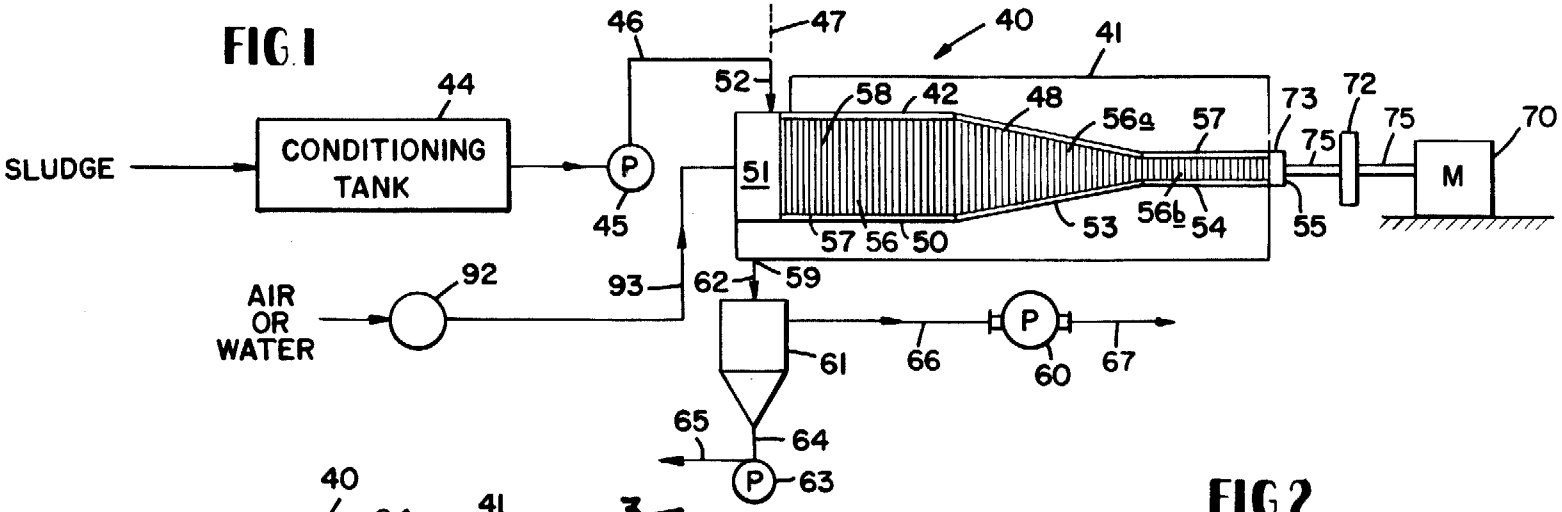
FIG. 1 is a schematic flow diagram, only partly representational, of a sludge-dewatering system embodying the principles of the invention.

The General System (FIG. 1)

FIG. 1 shows a general system embodying the principles of the invention.

The system comprises a filter-dewatering-expression press 40 having a generally imperforate filtrate or liquid collection housing 41, a filter-dewatering structure 42, and a combination sludge compression and dewatered solids discharge screw conveyor 43.

When the press 40 is used to process sludge, it may be connected to a sludge conditioning tank 44. The condition of sludge in the tank 44 may be, for example, by chemical treatment, by polyelectrolyte addition, by heat conditioning, or by freezing. The conditioned sludge may flow under pressure via a variable speed pump 45 and a conduit 46, or may flow by gravity in the conduit 46 to the press 40.

When the press 40 is utilized for dewatering-expression of conventional vacuum filter or centrifuge cake, to achieve a more thorough removal of liquid from the cake, the sludge may be introduced to the press 40 via a screw conveyor feed system 47 (shown dotted) in lieu of the pump 45 and the conduit 46.

The filter-dewatering structure 42 of the press 40 has a filter-dewatering medium 48 and preferably comprises an initial cylindrical portion 50, which includes a sludge input end 51 and an inlet connection 52. The sludge input end 51 preferably has a removable end plate 251 to enable insertion of the screw conveyor 43 into and removal from the filter-dewatering structure 42. The sludge input end 51 may be machined to provide a recessed surface 252 for receiving and positioning the removable end plate 251 and may be locked in position by locking plates 253 and screws 254.

The cylindrical portion 50 is followed by a frustoconical portion 53, which in turn is followed by a smaller diameter terminal cylindrical portion 54, which includes a dewatered solids output opening 55. The filter-dewatering structure 42 disclosed in my earlier U.S. Pat No. 3,695,173 may be used, wherein the filter-dewatering medium 48 comprises a series of hoops or rings 56, 56*a*, and 56*b* that are separated and closely spaced from each other and are held rigidly together as a single unit (as by heli-arc welds) to a reinforcing frame 57. Annular spaces 58 between the filter-dewatering rings 56, 56*a*, 56*b* provide escape passages through which liquid or filtrate can be forced but are not wide enough to permit escape of the solids. The filter-dewatering hoops or rings 56, 56*a*, 56*b* may be various widths and may be held apart at various spaces 58 of separation, to provide various open areas.

The imperforate filtrate or liquid collection housing 41 surrounds the structure 42 and collects the filtrate or liquid that was associated with the sludge and has a liquid or filtrate outlet 59.

A vacuum pump 60 and a gas-liquid separator 61 are connected to the imperforate outer housing 41 by a conduit 62. Both air and filtrate enter the separator 61, which may be any of well-known apparatus to separate the air or other gas from the liquid. The filtrate or liquid enters a filtrate pump 63 via a conduit 64 and is pumped away through a conduit 65, while the air or other gas enters the vacuum pump 60 via a conduit 66 and is exhausted away through a discharge conduit 67.

A motor 70 turns a shaft 75 of the conveyor 43. For initial startup of the filter-dewatering press 40, a startup cap 72 is preferably utilized to plug temporarily the normally open dewatered solids output opening 55 of the terminal cylindrical portion 54 of the structure 42. The startup cap 72 is then screwed into position on a threaded sleeve 73, which is attached to the dewatered solids output opening 55. After dewatered solids accumulate sufficiently in the frustoconical portion 53 and the terminal cylindrical portion 54, the startup cap 72 is removed, to permit discharge of the dewatered solids by the rotating screw conveyor 43. Usually for initial startup, this takes only a few seconds.

Inlet pressure, when the pump 45 is utilized, raises the feed sludge above atmospheric, and along with the squeezing and pressing of the sludge which results during the conveyance and compression of the sludge through the filter-dewatering structure 42, a differential pressure is established between the sludge or other slurry within the structure 42 at a higher than atmospheric pressure and the filtrate collected from outside the structure 42 at less than atmospheric pressure, created by the vacuum pump 60. Filtrate or liquid associated with the sludge is forced or expelled through the open area defined by the annular spaces 58 between the filter-dewatering hoops or rings 56, 56*a*, 56*b* of the structure 42, and is collected outside the structure 42 by the filtrate housing 41. The solids are deposited or retained on the inner surface of the structure 42, and are conveyed through the structure 42 for further compression and dewatering, and they pass relatively dry out the dewatered solids output opening 55, conveyed by the sludge compression and dewatered solids discharge screw conveyor 43.

This is the general system. Certain problems arise when practicing it that are solved by the present invention. The problems and the solutions will be better understood by considering the press 40 in more detail.

A Specific Press 40 in more Detail (FIGS. 2–6 and 13–17)

Figure 2:
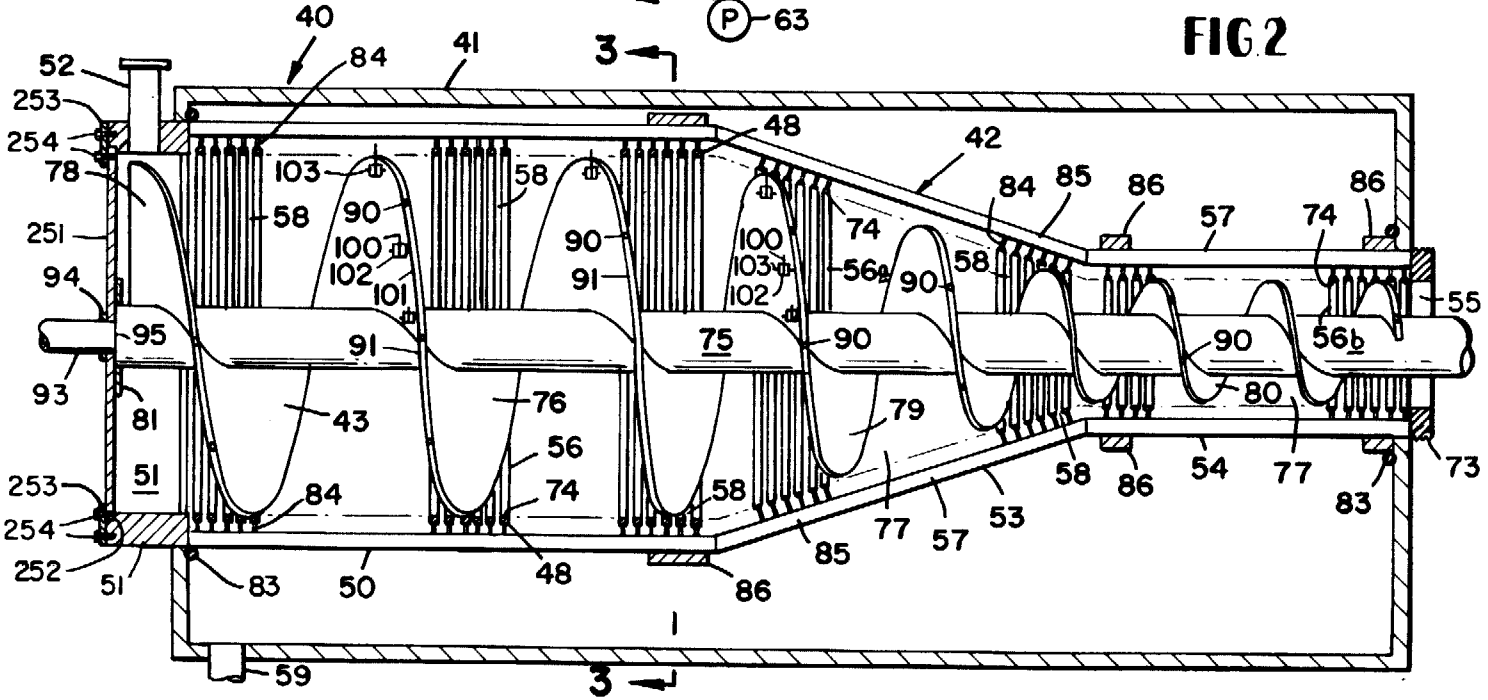
FIG. 2 is a side elevational view, partially in section, of a filter-dewatering-expression press of this invention. It is on an enlarged scale with respect to FIG. 1.
Figure 3:
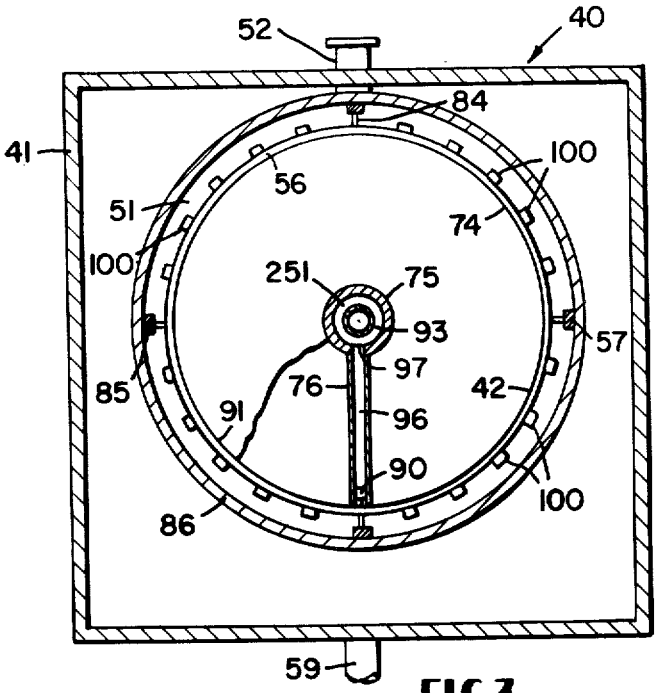
FIG. 3 is a sectional view taken along the line 3—3 in FIG. 2.

FIGS. 2 and 3 show the filter-dewatering press 40 in more detail and show the conveyor 43 in detail also.

The inner surface 74 of the filter-dewatering medium 48 is finished smooth as by grinding, to provide a flat or uniform dewatering and conveying surface. As one example, I have found that filter-dewatering hoops or rings 56 having a width of 0.250 inch and having a space 58 of separation of 0.008 inch with a 0.250 inch wall thickness can be readily fabricated and assembled, and gives optimum open area of the filter-dewatering medium 48, for an excellent dewatered sewage solids production rate, with low solids in the filtrate, at low chemicals, for conditioning. The hoops or rings 56, 56*a*, 56*b* may be alloy steel or plastic.

Figure 4:
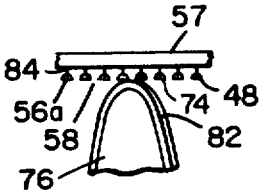
FIG. 4 is a fragmentary sectional view of FIG. 2, showing a wearable replaceable leading edge or strip on the combination sludge compression and dewatered solids discharge screw conveyor.

The combination sludge compression and dewatered solids discharge screw conveyor 43 comprises a constant diameter central shaft 75 along its axis on which is mounted a spiral-helical blade or flight 76, conforming closely to the inner surface 74, of the filter-dewatering structure 42, providing a spiral-helical space or extrusion channel 77 defined by the space between the central shaft 75 and the inner surface 74 of the filter-dewatering structure 42 extending from the sludge input end 51 to the dewatered solids output opening 55. The blade or flight 76 may be of constant pitch or may have a variable pitch, as shown in FIG. 2, includes a feed portion 78, disposed within the sludge input end 51, a compression portion 79, and a dewatered solids discharge portion 80. The blade or flight 76 is continuous, or if desired, may be an interrupted helical or spiral flight arrangement. The screw conveyor shaft 75 is supported for rotation within the structure 42 at the sludge input end 51, by means of a shaft bearing and seal 81 attached to the removable end plate 251, or if desired, may be supported outside the input end 51 for rotation. The other end of the screw conveyor shaft 75 protrudes the dewatered solids output opening 55 and is connected to a suitable source of power, such as a variable speed reversing drive assembly 70. A wearable replaceable leading edge or strip 82, such as Teflon, rubber, or plasticized polyvinyl chloride material, may be provided and attached to the screw conveyor blade or flight 76 as shown in FIG. 4. However, the structure of FIGS. 13–17 is preferred.

The filtrate collection housing 41 is sealed to the filter-dewatering structure 42 by seals 83 at the initial cylindrical portion 50 and at the terminal cylindrical portion 54.

The filter-dewatering structure 42 may have its rings 56, 56*a*, and 56*b* secured rigidly to the frame 57 by heli-arc welds 84 (FIGS. 2–4), and the frame 57 may comprise a longitudinally extending series of support rods 85 with circular holding bands 86.

As an example of relative sizes, the following is given for a filter-dewatering-expression press 40 for dewatering sewage sludge:

| | |
|---|---|
| Sludge input end inside diamter | 10" |
| Dewatered solids output opening inside diameter | 4" |
| Central shaft outside diameter | 2" |
| Helical blade or flight pitch | 4" |
| Filter-dewatering ring width | 0.250" |
| Annular spaces between rings | 0.008" |
| Length of initial cylindrical portion | 36" |
| Length of frustoconical portion | 24" |
| Length of terminal cylindrical portion | 14" |

With the structure so far described there is a problem of plugging or blinding of the open area of the filter-dewatering press 40 or the annular spaces 58 between the filter-dewatering hoops or rings 56, 56*a*, 56*b* of the filter-dewatering structure 42, and interruption of continuous filtration-dewatering.

The present invention solves this problem, preferably by providing, as shown in FIGS. 13–17, a coil-spring wiping or cleaning blade 87. This blade 87 may be positioned on the outside edge of the blade 76 by a series of guides 88. There is continuous contact between the coil-spring blade 87 and the inside surface 74 of the filtering dewatering medium 48, due to the spring action or the expansion tendency of the blade 87. This continuous contact causes the wiping and thus the cleaning of solids from the inner surface 74.

The coil-spring wiping or cleaning blade 87 may be fabricated in any suitable manner or may be coiled from pieces of various dimensions. However, I have found that steel rod of rectangular cross section 0.041 × 0.153 inches, coiled and then heat treated to provide a coil having an inside diameter slightly larger than the diameter of the screw conveyor blade 76 and having a pitch equal to the pitch of the screw conveyor 43, provides good contact for continuous wiping or cleaning without excessive pressure and without excessive wear of the inside surface 74 of the medium 48. The blade 87 may be a continuous helical coil or blade which extends along the entire radially outer edge of the spiral helical blade 76; one end of such a coil-spring blade 87 may be attached rigidly to the blade 76. Alternatively, there may be a series of shorter blades 87, each one following another, with one end of each attached rigidly to the blade 76. Rigid attachment at only one end enables the blade or blades 87 to be compressed, so that the screw conveyor 43 can be inserted with blade 87 into the filter-dewatering structure 42; after insertion, the blade 87 tends to expand, due to its spring action, and provides the desired continuous contact with the surface 74, giving effective cleaning of the solids from the surface 74.

Figure 13:
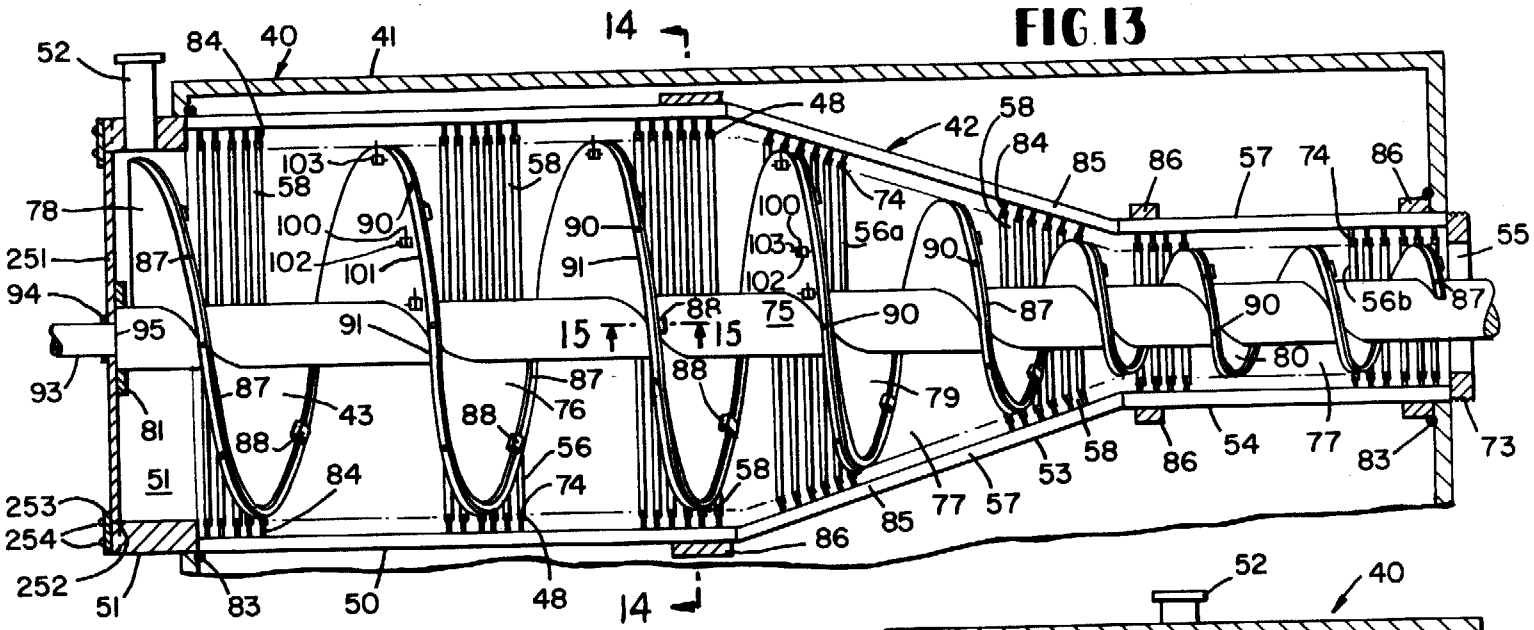
FIG. 13 is a view similar to FIG. 2 wherein a coil-spring wiping or cleaning blade is provided along the outside edge of the screw conveyor.
Figure 14:
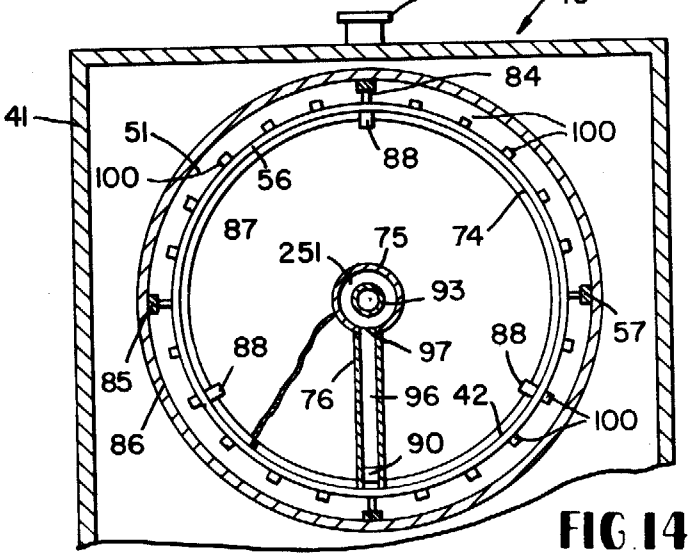
FIG. 14 is a view taken along the line 14–14 in FIG. 13.
Figure 15:
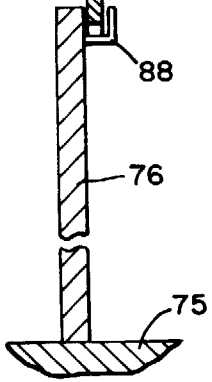
FIG. 15 is a fragmentary sectional view taken along the line 15–15 in FIG. 13.

As shown in FIG. 13, 14 and 15, the blade 87 may be positioned by the short guide clips 88, which are attached to the screw conveyor flight 76 and allow compression and expansion of the blade 87. As the blade 87 wears, its spring action continues to assure good contact with the surface 74 and therefore good cleaning as the screw conveyor 43 rotates.

Figure 16:
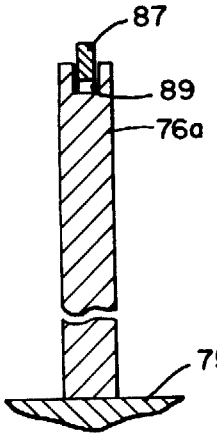
FIG. 16 is a view similar to FIG. 15 of a modified form of support for the coil-spring blade.

FIG. 16 shows an alternative structure, in which the blade 87 is positioned with a groove 89 of a helical blade 76a.

Figure 17:
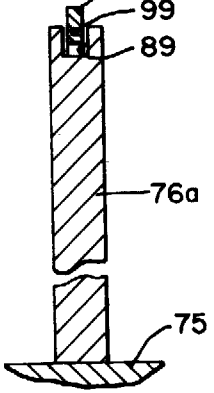
FIG. 17 is another view similar to FIG. 15 of another modified form of support and a modified type of coil-spring blade.

FIG. 17 shows an alternative spring blade structure. Here, a rubber or plasticized polyvinyl chloride or other plastic blade 98 contains a coil spring 99. The spring 99 provides the spring action or tendency to expand, while the plastic blade 98 does the actual wiping of the surface 74.

To assist in the cleaning of the annular spaces 58 between the filtering-dewatering rings 56, 56*a* and 56*b*, cleaning nozzles 90 may be utilized. These nozzles 90 may be an integral part of, or attached to the outer edge 91 of the helical blade or flight 76, projecting out radially and spaced apart. The nozzles 90 discharge, under pressure, a forceful blast of fluid (air or other gas, steam, or water) into the annular spaces 58 between the filter-dewatering rings 56, 56*a*, 56*b* to positively dislodge material therein and keep the filter-dewatering medium 48 unplugged, non-blinded, clean, and open. The fine solids which have entered and become wedged in the annular spaces 58 between the filter-dewatering rings 56, 56*a*, 56*b* tending to plug or blind the open area of the filter-dewatering medium 48, and the small portions of large solids which have entered the annular spaces 58 between the hoops or rings 56, butcannot pass through and out due to the large portions of the solids being retained on the inner surface 74 of the filter-dewatering medium 48 of the structure 42, are dislodged and pass through and out with the filtrate with the blasting or cleaning action of the filter-dewatering medium cleaning nozzles 90, when the rotating spiral-helical blade or flight 76 of the screw conveyor 43, along with the coil-spring wiping or cleaning blade 87, cuts and scrapes away the solids retained on the inner surface 74 of the medium 48.

The fluid (air or other gas, steam, or water) comes from a suitable fluid supply 92 (such as an air compressor, steam generator, or water supply) and enters the filter-dewatering press 40 via a conduit 93 (see FIGS. 1, 2, 3, and 5), which is aligned with and sealed by a rotating union 94 to the hollow central shaft 75 at the sludge input end 51. A hole 95 in the sludge input end plate 251 of the structure 42 which is aligned with the conduit 93 and the hollow screw conveyor shaft 75 is utilized to provide an non-blocked passage for the fluid to enter the screw conveyor shaft 75. See FIGS. 2, 3, 4, 5, and 6.

Figure 6:
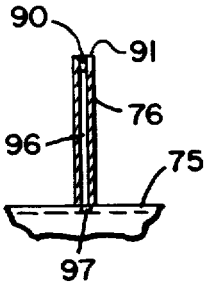
FIG. 6 is a sectional view taken along the line 6—6 in FIG. 5, showing a distribution pipe and filter-dewatering medium cleaning nozzle within the spiral-helical blade or flight of the screw conveyor.
Figure 5:
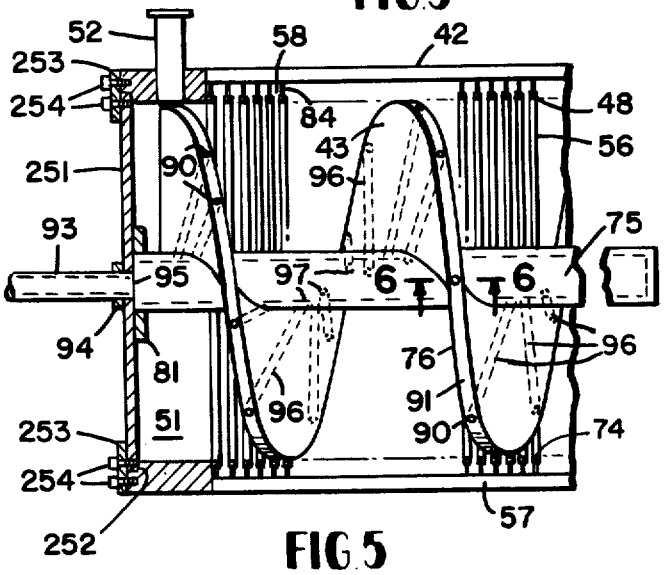
FIG. 5 is a fragmentary sectional view of FIG. 2, showing the distribution pipes for the filter-dewatering medium cleaning nozzles.

FIGS. 3, 5, and 6 illustrate distribution pipes 96 positioned within or being an integral part of, the helical blade or flight 76 of the screw conveyor 43. A filter-dewatering medium cleaning nozzle 90 is attached to each distribution pipe 96 at the outer edge 91 of the blade or flight 76. Numerous holes 97 in the hollow screw conveyor shaft 75 are utilized, each hole 97 being aligned with a distribution pipe 96 for distribution of the air or other gas, steam, or water to the filter-dewatering medium cleaning nozzles 90 from the fluid-filled hollow screw conveyor shaft 75.

Figure 7:
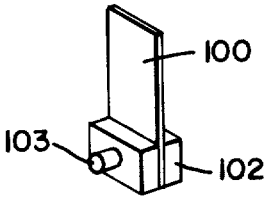
FIG. 7 is an enlarged view in perspective of one cutter or annular slot cleaning blade.

FIGS. 2, 3, and 7 illustrate the nozzles 90 utilized with cutter or annular slot cleaning blades 100 like those of my earlier U.S. Pat. No. 3,695,173. These blades 100 assist the coil-spring wiping blade 87 of FIGS. 13–16 or the blade 98 of FIG. 17, and also assist the nozzles 90 in keeping the filter-dewatering medium 48 or annular spaces 58 between the filter-dewatering rings 56, 56*a*, 56*b* unplugged, non-blinded, clean, and open. The blade 87 or 98, the nozzles 90 and the blades 100, may, however, be utilized independently.

When the cutter or annular slot cleaning blades 100 are utilized, they are secured to the outer trailing surface 101 of the sludge compression and dewatered solids discharge screw conveyor helical blade or flight 76 by a cutter blade holder 102 with a spring loaded pin 103, as shown in FIGS. 2, 7, and 18. The blades 100 project out radially and are spaced to extend and lock into their cutting or cleaning position in the annular spaces 58 to positively dislodge material therein and keep the filter-dewatering medium 48 unplugged, non-blinded, clean, and open. The fine solids which have entered and become wedged in the annular spaces 58 between the filter-dewatering rings 56, 56*a*, 56*b* tending to plug or blind the open area of the medium 48, and the small portions of large solids which have entered the annular spaces 58 between the rings 56, 56*a*, 56*b*, but cannot pass through and out, due to the large portions of the solids being retained on the inner surface 74 of the medium 48, are dislodged and pass through and out with the filtrate, due to the cutting or cleaning action of the cutter or annular slot cleaning blades 100, when the rotating spiral-helical blade or flight 76 of the screw conveyor 43, especially when used with the blade 87 or 98, cuts and scrapes away the solids retained on the inner surface 74. The solids tending to clog or blind the annular spaces 58 may be forced back into the spiral-helical extrusion channel 77 by the cutting or cleaning action of the rotating blades 100, depending upon the angle of the blades 100 with respect to the filter-dewatering rings 56, 56*a*, 56*b*, for further pressing and dewatering and for capture within the dewatered solids that have discharged out through the dewatered solids output opening 55 in relatively dry form. The cutter-slot cleaning blades 100 are preferably spring steel-like material.

Plural-section Screw Conveyors (FIGS. 18–12):

FIGS. 8-12 illustrate a group of modified embodiments of this invention wherein plural-section screw conveyors are utilized within a filter-dewatering structure. Here again, the blade 87 or 98 is preferably present, though not shown in the drawings. Each section of the screw conveyor is capable of being rotated at a different speed, and the difference in speeds is used to regulate the quantity and dryness of the dewatered solids being discharged from the press. A differential gear drive, such as a planetary gear drive may be used to obtain the differential speed desired. A double-shaft drive unit may be used to drive both shafts concentric to each other, so that each shaft and each conveyor section can have independent speed of rotation. The differential speed of rotation between the screw conveyor sections may be controlled automatically by a torque-sensing actuator device wired to the drive unit. The filter-dewatering structure 42 of FIG. 2 is shown; however, other filter-dewatering structures previously described may be used.

Figure 8:
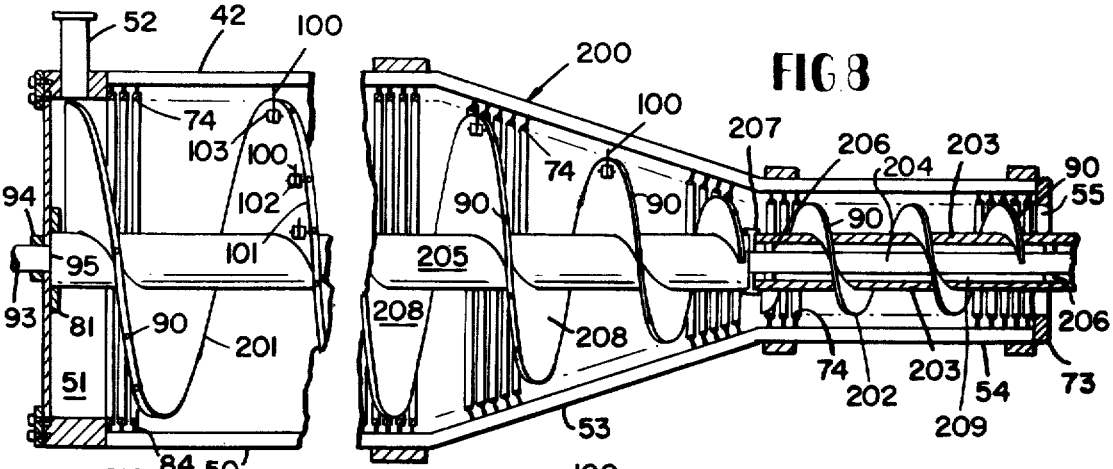
FIG. 8 is a view similar to FIG. 2 of a modified form of press embodying the invention, wherein a plural-section screw conveyor is used to provide different speeds in each of two different portions of the press.

In FIG. 8, a press 200 comprises the structure 42 in combination with a screw conveyor 201. The screw conveyor 201 has a spiral-helical blade or flight 202 in the terminal cylindrical portion 54 of the filter-dewatering-expression press 200, the filtrate housing 41 not being shown. The blade press 202, is the dewatered solids discharge screw conveyor section. The flight or blade 202 is mounted on an outer shaft 203 which slips over, is concentric to, and rotates around a reduced diameter portion 204 of a main shaft 205 for the screw conveyor 201. The shaft 203 is supported for rotation relative to the shaft portion 204 by bearings 206, and sealed by a seal 207 to the main shaft 205. There is a space 209 between the shaft 203 and the shaft portion 204. The main shaft 205 supports a spiral-helical blade or flight 208 in the initial cylindrical portion 50 and in the frustoconical portion 53 of the structure 42. This blade 208 may be referred to as the sludge feed and compression screw conveyor section, and it is a continuous spiral-helical blade; it follows closely the uniform inner surfaces 74 of the initial cylindrical portion 50 and of the frustoconical portion 53. Both blades 202 and 208 of the screw conveyor 201 are of the same "hand," and rotate in the same direction of rotation. The helical blade or flight 202 follows closely the uniform inner surface 74 of the terminal cylindrical portion 54. The coil-spring wiping or cleaning blade 87 or 98 and the cleaning nozzles 90 are utilized as before along with cutter or annular slot cleaning blades 100 in the initial cylindrical portion 50 and in the frustoconical portion 53, and the cutter or annular slot cleaning blades 100 may be utilized in the terminal cylindrical portion 54. Also, a coil-spring blade 87 or 98 and cleaning nozzles 90 may be utilized in the terminal cylindrical portion 54. The fluid for the nozzles 90 may be introduced into the space 209 and by using distribution pipes (not shown) to connect the space 209 to the nozzles 90.

Figure 9:
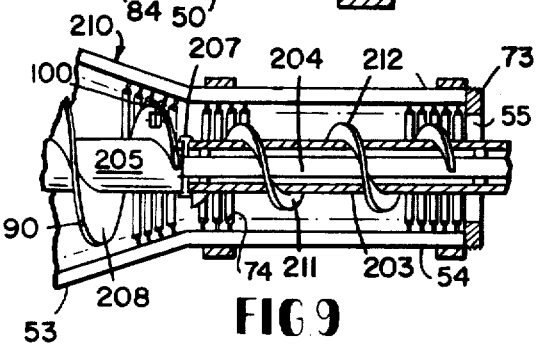
FIG. 9 is a view similar to FIG. 8 and represents a modification thereof, wherein the edge of the terminal portion of the screw does not wipe the terminal portion of the filter-dewatering structure but is spaced radially inwardly therefrom.

FIG. 9 illustrates a press 210 which is like the press 200 of FIG. 8 except that it has a spiral-helical blade or flight 211 in the dewatered solids discharge section 54 which does not follow closely the uniform inner surface 74 of the terminal cylindrical portion 54. Instead, the diameter of the spiral-helical blade or flight 211 is approximately one-half the diameter of the dewatered solids output opening 55. Its edge 212 thus does not wipe the surface 74 but is spaced apart from it. No coil-spring blade 87 or 98, no cleaning nozzles 90, and no cutter or annular slot cleaning blades 100 are utilized in the terminal cylindrical portion 54.

Figure 10:
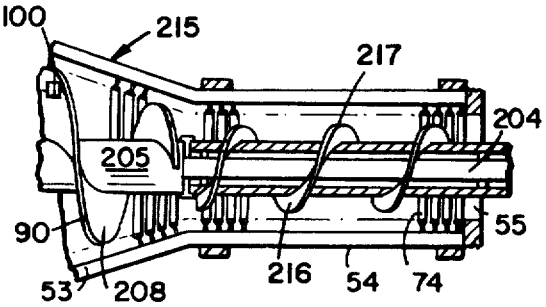
FIG. 10 is a view similar to FIG. 9 showing another modification, wherein the terminal portion of the screw is of opposite hand from the remainder of the screw.

FIG. 10 shows a press 215 much like the press 210 and differing only in that it has screw conveyor section 216 in the terminal cylindrical portion 54 that is of different hand from the main screw conveyor 208 in the initial cylindrical portion 50 and in the frustoconical portion 53. The dewatered solids discharge screw conveyor section 216 in the terminal cylindrical portion 54 does not follow closely the uniform inner surface 74, but its edge 217 spaced from it, like the diameter of the edge 212 of the screw 211 of FIG. 9. The spiral-helical blade or flight 208 may be an interrupted helical or spiral flight arrangement, and the helical blade or flight 216 may be replaced by a single flight ribbon. Preferably, a coil-spring wiping or cleaning blade 87 or 98 and cleaning nozzles 90, along with the cutter or annular slot cleaning blades 100, are utilized in the initial cylindrical portion 50 and in the frustoconical portion 53.

Figure 11:
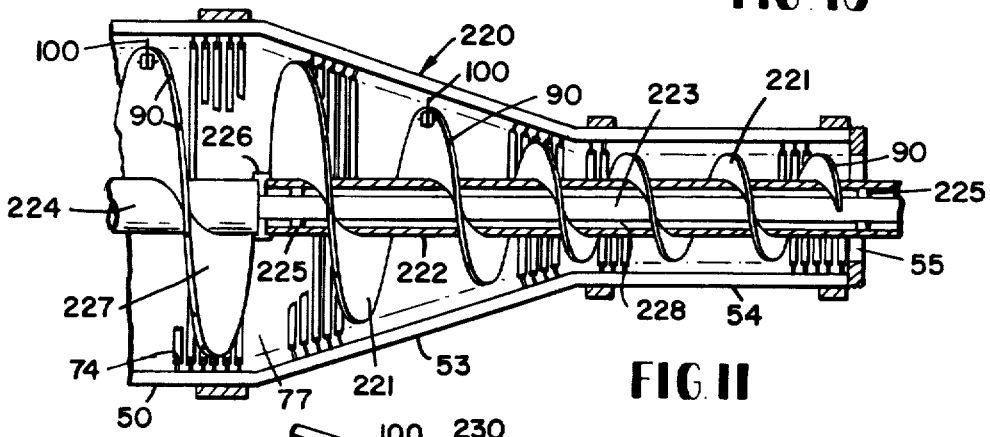
FIG. 11 is a view similar to FIG. 8 having a somewhat different type of plural-section screw conveyor.

FIG. 11 shows a press 220 having another type of plural-section sludge-compression and dewatered-solids-discharge screw conveyor. A helical blade or flight section 221 in the frustoconical portion 53 and in the terminal cylindrical portion 54 is a continuous helical blade, and is mounted on an outer tubular shaft 222 which slips over, the concentric with, and rotates around a reduced-diameter portion 223 of a shaft 224. The shaft 222 is supported for rotation relative to the shaft portion 223 by bearings 225 and is sealed by a seal 226. A screw conveyor section 227 in the initial cylindrical portion 50 comprises a spiral-helical blade or flight mounted on the shaft 224. Both screw conveyor sections 221 and 227 rotate in the same direction of rotation in this embodiment, and are both of the same hand. Both spiral-helical blades 221 and 227 follow closely the uniform inner surface 74 of the initial cylindrical portion 50 and of the frustoconical portion 53 and may follow closely the uniform inner surface 74 of the terminal cylindrical portion 54, as in FIG. 11. Preferably, a coil-spring wiping blade 87 or 98 and cleaning nozzles 90 are utilized, along with the cutter or annular slot cleaning blades 100 in the initial cylindrical portion 50. Both a coil-spring blade 87 and 98 and cutter or annular slot cleaning blades 100 may be utilized in the frustoconical portion 53 and in the terminal cylindrical portion 54. Cleaning nozzles 90 may also be utilized in the portions 53 and 54 by conducting their fluid via the space 228 between the shaft 222 and the shaft portion 223 and by using distribution pipes (not shown) to connect the space 228 to the nozzles 90.

Figure 12:
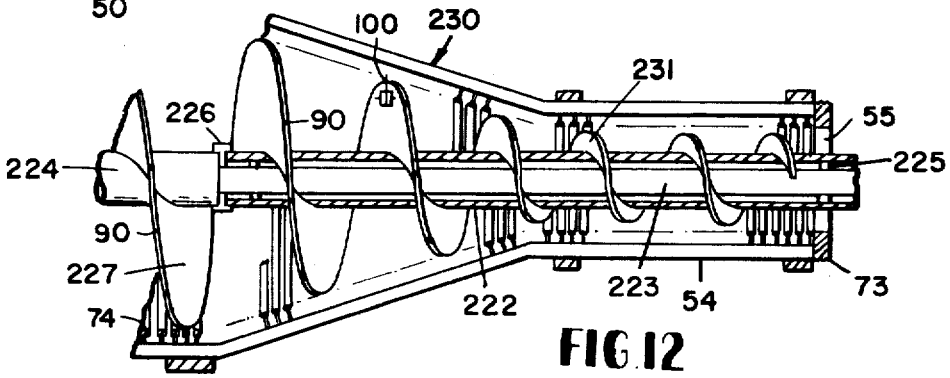
FIG. 12 is a view similar to FIG. 11 in which the terminal portion of the screw conveyor is spaced inwardly from the filter-dewatering structure, as in FIG. 9.

FIG. 12 shows a press 230 generally like the press 220 and differing only in that it has a spiral-helical blade or flight 231, which in the terminal cylindrical portion 54 does not follow closely the uniform inner surface 74, but instead, in that portion has a diameter approximately one-half the diameter of the dewatered solids output opening 55. No coil-spring blade 87 or 98, no cutter or annular slot cleaning blades 100, and no cleaning nozzles 90 are utilized in this terminal cylindrical portion 54.

The differential speed of rotation of the plural-section sludge compression and dewatered solids discharge screw conveyors and the counter pressure which can be created in the different portions of the structure 42 of FIGS. 8, 9, 11, and 12, and the counterdischarge effect as in FIG. 10 when the screw conveyor sections 208 and 216 are of opposite hand, along with other design parameters of the dewatering press enable regulation of the detention time of the sludge within the different portions 50, 53, and 54 changing the dewatering and compression rates within the different portions 50, 53, and 54, therefore controlling the quantity and dryness of the dewatered solids discharged from the press.

Pressures inside the filter-dewatering-expression press 40 may reach 2000 lb./sq.in. or more. The exact pressure will depend upon the design parameters of the individual press and the nature and consistency of the sludge or slurry to be dewatered.

The speed of rotation of the sludge compression and dewatered solids discharge screw conveyor 43 may vary from about 10 rpm to over 200 rpm.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A device for dewatering sludge, including in combination:

a filter-dewatering shell having an initial portion, a succeeding portion and a terminal portion, each comprising means for exit of fluid and retention of solid particles, filtrate collection means outside said shell and spaced therefrom, for collecting filtrate, a main shaft along the axis of said filter-dewatering shell in said initial and succeeding portions and having a reduced-diameter portion in said terminal portion, a secondary shaft rotatably mounted on said reduced-diameter portion of said main shaft in said terminal portion, a main sludge compression blade secured to said main shaft in said initial and succeeding portions, said blade providing means for wiping the inner surfaces thereof, said means for wiping comprising a coil-spring blade supported by said main blade along its radially outer edge, a filter-cake-discharging blade secured in said terminal portion to said secondary shaft, and power means for rotating said shafts at different speeds relative to each other.

2. The device of claim 1 wherein said coil-spring wiping blade comprises a metal rectangular in cross section with one end secured rigidly to said spiral-helical blade.

3. The device of claim 2 wherein said wiping blade is retained adjacent one side of said radially outer edge of said spiral-helical blade by retaining and guide means.

4. The device of claim 1 wherein said wiping blade comprises a continuous strip of plastic, rectangular in cross section and containing a coil-spring wire.

5. The device of claim 1 wherein said spiral-helical blade has a recess in its said radially outer edge and said wiping blade is positioned therein.

6. The device of claim 1 wherein said filter-cake-discharging blade also provides, as means for wiping the inner surfaces it faces, a coil-spring blade supported by said filter-cake-discharging blade along its radially outer edge.

7. A device for dewatering sludge, including in combination:

a filter-dewatering shell having an initial portion, a succeeding portion and a terminal portion, each comprising means for exit of fluid and retention of solid particles, filtrate collection means outside said shell and spaced therefrom, for collecting filtrate, a main shaft along the axis of said filter-dewatering shell in said initial portion and having a reduced-diameter portion in said succeeding portion and said terminal portion, a secondary shaft rotatably mounted on said reduced-diameter portion of said main shaft in said succeeding and terminal portions, a main sludge compression blade secured to said main shaft in said initial portion, and having means for wiping the inner surfaces thereof, and means for wiping comprising a coil-spring blade secured to said main blade along the radially outer edge thereof, sludge compression and filter-cake-discharging blade secured in said succeeding and terminal portions to said secondary shaft, and power means for rotating said shafts at different speeds relative to each other.

8. The device of claim 7 wherein said coil-spring wiping blade comprises a metal spring rectangular in cross section with one end secured rigidly to said spiral-helical blade.

9. The device of claim 8 wherein said wiping blade is retained adjacent one side of said radially outer edge of said spiral-helical blade by retaining and guide means.

10. The device of claim 7 wherein said wiping blade comprises a continuous strip of plastic, rectangular in cross section and containing a coil-spring wire.

11. The device of claim 7 wherein said spiral-helical blade has a recess in its said radially outer edge and said wiping blade is positioned therein.

12. The device of claim 7 wherein said sludge compression and filter-cake-discharging blade also provides, as means for wiping the inner surfaces it faces, a coil-spring blade secured to said sludge compression and filter-cake-discarging blade along the radially outer edge thereof.

* * * * *